United States Patent [19]

Evans et al.

[11] Patent Number: 5,020,765

[45] Date of Patent: Jun. 4, 1991

[54] U-SHAPED ANTENNA MOUNTING ASSEMBLY

[75] Inventors: Jack Evans; Christopher R. Morley, both of Mokena, Ill.

[73] Assignee: Cellular IC, Mokena, Ill.

[21] Appl. No.: 516,259

[22] Filed: Apr. 26, 1990

[51] Int. Cl.[5] ..... H01Q 1/32

[52] U.S. Cl. ..... 248/539; 248/231.7; 343/715

[58] Field of Search ..... 248/539, 231.7, 231.6, 248/231.8, 220.2, 222.2; 343/892, 711, 713, 715

[56] References Cited

U.S. PATENT DOCUMENTS

D. 248,026 5/1978 Gostomski ..... 343/715 X 4,028,705 6/1977 Loyd ..... 343/715

4,109,252 8/1978 Hacker ..... 343/715

4,149,694 4/1979 Verini ..... 248/539

4,158,844 6/1979 Wood ..... 248/539 X

*Primary Examiner*—Ramon O. Ramirez

*Assistant Examiner*—Robert A. Olson

*Attorney, Agent, or Firm*—Hawes & Fischer

[57] ABSTRACT

The improved U-shaped antenna mounting assembly consists of a U-shaped clip and a U-shaped bracket, the bracket overfitting the clip, the base of the clip being notched to receive in that notch the base portion of the bracket. Preferably indentations are provided in the clip and the bracket to assist in interlocking them with one another.

9 Claims, 1 Drawing Sheet

U-SHAPED ANTENNA MOUNTING ASSEMBLY

FIELD OF THE INVENTION

This invention relates to an improved U-shaped antenna mounting assembly, particularly one which permits an antenna to be easily attached to and removed from a rigid planar member such as the trunk of an automobile.

BACKGROUND OF THE INVENTION

It is often desired to attach an antenna to a planar surface, such as the trunk of an automobile. For example, in many installations of a citizens band radio or a car telephone in an automobile, the owner prefers for the antenna to be removable rather than rigidly attached to the car, and for the attachment to not damage or mar the car's finished surface.

One such U-shaped antenna mounting assembly suitable for such applications is set forth in United States Pat. No. 4,149,694 issued Apr. 17, 1979 to Anthony J. Verini. Briefly, the Verini assembly consists of a U-shaped clip for receiving the antenna, which clip interfits with a U-shaped bracket attached to planar member, such as the trunk of an automobile. The clip interfits with the bracket; its lower flange is received in a slot provided in the bracket, thereby holding the clip to the bracket and to the car. At times it is quite difficult to remove the clip from the bracket. The clip may have corroded, or dirt and debris become lodged between the clip and the bracket, virtually welding the two together. Also, the Verini assembly consists of three discrete elements.

It would be desirable to improve the Verini style of clip by providing an attachment between the clip and the bracket that locks the two together, yet which also permits the bracket to be readily removed from the clip. In addition, it would be desirable to reduce or simplify the number of elements required in the Verini assembly. These and other objects of the present invention will be apparent from the following description of a preferred embodiment.

SUMMARY OF THE INVENTION

The present invention provides in improved U-shaped antenna mounting assembly that permits an antenna to be securely attached to a planar surface, such as to the trunk of a car, yet to be easily removed when desired. This assembly consists of a bracket that supports the antenna and a clip that may be attached to the car. When assembled, the bracket is securely captured by the clip and locked to the car. Also, the antenna is held close to the car, which many believe to improve the appearance of the resulting assembly. In addition, the present invention eliminates one of the elements of the Verini clip.

In its preferred form, the present invention provides an assembly that consists of two elements, a U-shaped clip and a U-shaped bracket The clip may be attached to the automobile or other planar surface; the bracket receives the antenna. The base portion of the clip has at least one section that is removed, as does the U-shaped bracket, the resulting base portions of the clip and bracket thereby interfitting with one another. The legs, or upstanding planar portions of the bracket extend over the corresponding portions of the clip. Corresponding dimples or ridges are provided in the planar portions of the clip and bracket to assist in interlocking the two.

In its preferred form the center area of the base portion of the clip is removed, and receives the center area of the base portion of the U-shaped bracket, the bracket thereby being captured between the remaining legs of the base portion of the clip and prevented from lateral movement relative to the clip. In short, the present invention differs from the Verini clip in that, in the present invention the U-shaped bracket extends over both the top and the bottom of the clip whereas in Verini the bottom extension of the bracket is received in a slot provided between two members of the clip.

Thus, the antenna mounting assembly of the present invention consists basically of two elements, a clip and a bracket. The bracket is securely held to the planar member by the clip, but, it may be easily removed.

BRIEF DESCRIPTION OF THE DRAWING

The present invention will be further described in connection with the accompanying drawing in which.

DETAILED DESCRIPTION

Figure 1:
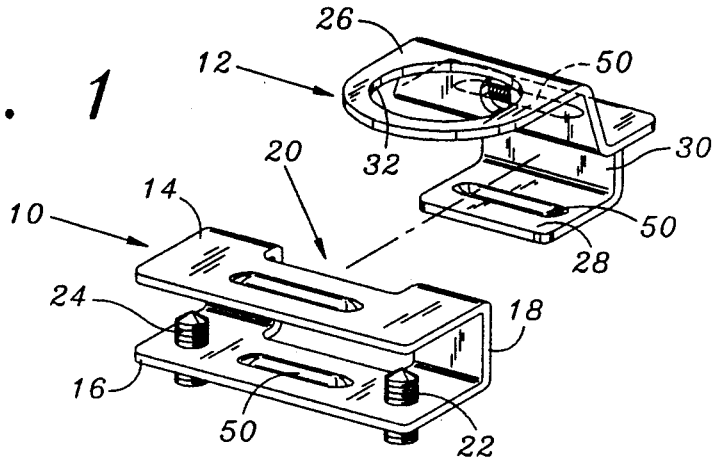
FIG. 1 is a perspective view of the improved U-shaped antenna mounting assembly cf the present invention.

In its preferred embodiment, the present invention provides an antenna mounting assembly that includes, as shown in FIG. 1, a clip 10 and a bracket 12. Both clip and bracket are generally U-shaped. Clip 10 includes two parallel legs or planar portions, an upper portion 14 and a lower portion 16. The base portion of the U-shaped clip is shaped such that the inner section is removed to provide two side wall portions 18 with a slot 20 there between A pair of openings 22 are provided in the base portion 16 to receive screws 24 that enable the clip to be securely attached to a planar member, such as the trunk lid of an automobile.

Bracket 12 also includes a pair of legs; namely, an upper planar member 26 and a lower planar member 28, the upper and lower planar members being approximately as wide as the upper and lower planar members 14 and 16 of the clip. The base portion 30 of the bracket is reduced in width to be received in slot 20 of the clip. The upper portion 26 of the bracket includes a circular opening 32.

Figure 2:
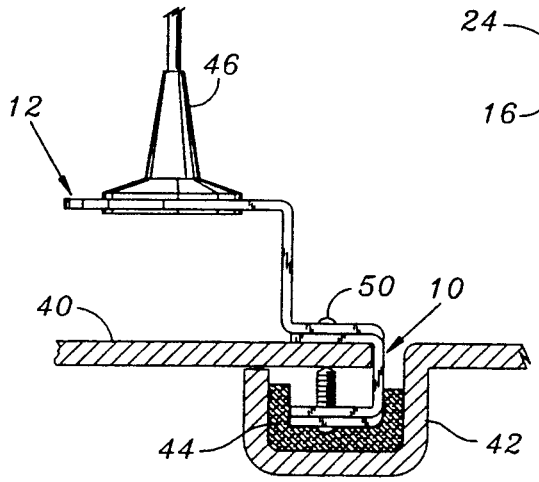
FIG. 2 is an elevational view of the antenna mounting assembly attached to the trunk lid of an automobile.
Figure 4:
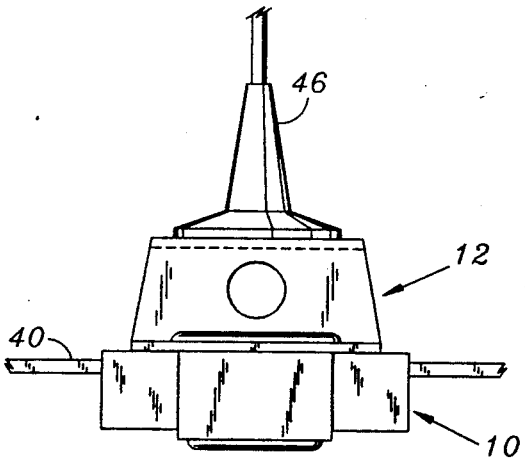
FIG. 4 is an elevational view of the base of the antenna mounting assembly attached to a planar member.

As shown in FIGS. 2 4, the antenna mounting assembly of the present invention may be easily attached to a planar member, such as the edge of a trunk lid 40 of a car. The edges of such a trunk lid normally overlie a channel 42 in the adjacent panel of the car, this channel being filled with a resilient sealing member 44 such as a foam strip. By opening the trunk lid, or lifting it to separate its edges from channel 42, clip 10 easily may be attached along the edge portion of the lid at an the desired location, screws 24 being rotating sufficiently to bring their tips to bear firmly against the underside of the trunk lid. Preferably at least the outer under surface of clip 10 (that which overlies the trunk lid) is coated or covered with a sheet or membrane to prevent its marring of the trunk lid's surface.

Figure 3:
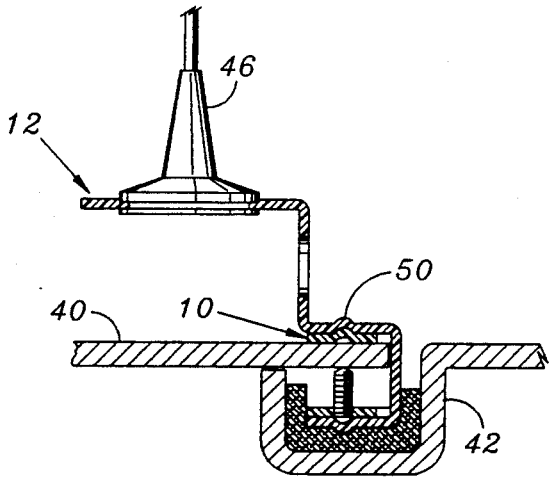
FIG. 3 is a vertical sectional view of the antenna mounting assembly shown in FIG. 2.

Once the clip has been attached to the trunk lid at the desired location, and an antenna 46 attached to bracket 12 in opening 32, the bracket may be slid over the clip as shown in FIGS. 2–4, such that base 30 of the bracket is received between base walls 18 of the clip, the bracket being sized relative to the clip to snugly overlie the clip. Preferably both the clip and the bracket include upstanding ridges or indentations 50 which interfit with one another to interlock and hold the bracket in a given position relative to the clip.

To remove the bracket, and the antenna it supports, from the clip it is only necessary to rotate the bracket slightly to misalign ridges 50 and permit the bracket to be easily slipped from the clip after the trunk lid is opened. If the trunk lid is shut, it is impossible to remove the bracket from the clip, for the bracket is captured against lateral movement relative to the clip by walls 18, and against movement away from the clip by virtue of channel 42 and the adjacent portion of the automobile's body.

While a presently preferred embodiment of the invention has been illustrated and described, since variations in the antenna mounting assembly will be apparent to those skilled in this field, the scope of the invention should not be limited to the embodiment disclosed but rather is set forth in the following claims.

We claim:

1. An improved U-shaped antenna mounting assembly having in combination:

a U-shaped clip with two parallel planar portions extending in the same direction from a base portion; the planar portions each including an inner and an outer face, the inner faces of the planar portions being the faces closest to one another;

at least one section of the base portion being removed between the two parallel planar portions;

means for attaching the clip to the edge of a rigid sheet member;

a U-shaped bracket with two parallel planar portions extending in the same direction from a base portion, at least one section of the base portion of the bracket being removed between the two parallel planar portions such that the remaining section of the base portion of the bracket and the remaining section of the base portion of the clip interfit with one another when the planar portions of the bracket extend over outer faces of the planar portions of the clip, thereby to hold the bracket in a fixed position relative to the clip; and means for attaching an antenna to the bracket.

2. An improved U-shaped antenna mounting assembly as set forth in claim 1 in which the planar portions of the U-shaped clip and U-shaped bracket include interfitting indentations, these indentations assisting in holding the bracket in a predetermined orientation relative to the clip.

3. An improved U-shaped antenna mounting assembly as set forth in claim 2 in which said attachment means are screws received in threaded openings in one of the planar portions of the clip.

4. An improved U-shaped antenna mounting assembly as set forth in claim 3 in which the planar portions of the clip and of the bracket are approximately equal in at lease one dimension such that the bracket substantially overlies and covers the clip.

5. An improved U-shaped antenna mounting assembly as set forth in claim 3 in which the planar portions of the bracket are substantially unequal in size, the larger planar portion of the bracket having an opening to receive the base portion of an antenna.

6. An improved U-shaped antenna mounting assembly as set forth in claim 5 in which the larger planar portion of the bracket includes three sections, a first section adjacent to the base portion of the bracket, a second section adjacent the first section and angled relative to the plane defined by the first section, and a third section adjacent the second section that defines a plane generally parallel to that defined by the first section and which includes the opening to receive the base portion of an antenna.

7. An improved U-shaped antenna mounting assembly as set forth in claim 1 in which the remaining base portion of the clip and bracket interlock the clip and the bracket to prevent lateral movement of the bracket relative to the clip.

8. An improved U-shaped antenna mounting assembly as set forth in claim 7 further including indentations in the planar portions of the clip and bracket, the indentations assisting in holding the bracket in a predetermined orientation relative to the clip.

9. An improved U-shaped antenna mounting assembly as set forth in claim 8 in which the center portion of the base portion of the clip is removed to provide two base legs with an opening therebetween extending between its planar portions, each leg connecting the parallel planar portions of the clip to one another, the opening receiving the base portion of the bracket and thereby interlocking the clip and bracket against lateral movement relative to one another.

* * * * *